US006210204B1

(12) United States Patent
Ko et al.

(10) Patent No.: US 6,210,204 B1
(45) Date of Patent: Apr. 3, 2001

(54) ELECTRICAL CONNECTOR HAVING BARRIER FOR PREVENTING ELECTRICAL SPARKS BETWEEN ADJACENT TERMINALS

(75) Inventors: David Tso-Chin Ko, Thousand Oaks; Eric Juntwait, Irvine, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,753

(22) Filed: Dec. 27, 1999

(51) Int. Cl.[7] ..... H01R 4/24

(52) U.S. Cl. ..... 439/404; 439/181; 439/679; 439/934

(58) Field of Search ..... 439/404, 934, 439/679, 181

(56) References Cited

U.S. PATENT DOCUMENTS 4,897,041 * 1/1990 Heiney et al. ..... 439/404
5,178,558 * 1/1993 Knox et al. ..... 439/404
5,632,639 * 5/1997 Hayashi ..... 439/271
5,954,541 * 9/1999 Ozai et al. ..... 439/608
6,109,979 * 8/2000 Garnett ..... 439/719
6,146,180 * 11/2000 Betker et al. ..... 439/352

* cited by examiner

*Primary Examiner*—Paula Bradley
*Assistant Examiner*—Truc Nguyen
(74) *Attorney, Agent, or Firm*—Wei Te Chung

(57) ABSTRACT

An electrical connector assembly comprises a housing having mating and rear surfaces, and defining first passageways between the mating and rear surfaces. A plurality of first terminals is assembled to the first passageways from the rear face. Each terminal has an insulation displacement section extending beyond the rear face. At least a slot is defined in the rear face separating at least one terminal from the rest of the first terminals thereby preventing sparks generated from therebetween. A cover is assembled to the rear face enclosing the insulation displacement sections of the terminals. The cover includes a barrier received in the slot of the housing thereby eliminating sparks resulted when the one terminal carries high voltage.

1 Claim, 6 Drawing Sheets

ELECTRICAL CONNECTOR HAVING BARRIER FOR PREVENTING ELECTRICAL SPARKS BETWEEN ADJACENT TERMINALS

FIELD OF THE INVENTION

The present invention relates to an electrical connector, and more particularly to an electrical connector having barrier for preventing sparks generated between adjacent terminals carrying high voltage.

DESCRIPTION OF THE PRIOR ART

Each computer is equipped with a power supply system which supplies power to a motherboard, and pertinent electrical devices, such as a floppy disk drive, hard disk drive and CD-ROM. Conventionally, the power supply system includes a plurality of harnesses interconnected between the motherboard, floppy disk drive, hard disk drive and CD-ROM and the power supply. Each harness includes a cable end connector. When the power supply is to be removed or changed, the connectors attached to the electrical devices shall be firstly disconnected, then the power supply can be removed.

In order to increase the efficiency of assembly, an enclosure of the computer is provided with a bay in which the power supply is seated. An end wall is provided with a connector coupled to a connector of the power supply system. By this arrangement, the power supply system can be conveniently inserted thereto or withdrawn therefrom.

In one of the application, a so called Distribution Power System (DPS) is right now under developing and equipped with a DPS connector which serves both signal and power transmission. Except the terminals for power supply, five pins are allocated for the field replacement unit information on the DPS power supply connector. One pin is used for the serial clock, while another pin is used for serial data. About three to five pins are used for address lines to indicate to the power supply's EEPROM which position the DPS power supply occupies in the power bay. In order to prevent electrical sparks happened between the power terminals and the signal terminals, measurements shall be introduced thereof.

SUMMARY OF THE INVENTION

An objective of this invention is to provide an electrical connector having a cover enclosing insulation displacement sections thereof. One terminal carrying high voltage is separated with the rest terminals by a barrier extending from the cover.

In order to achieve the objective set forth, an electrical connector in accordance with the present invention comprises a housing having mating and rear surfaces, and defining first passageways between the mating and rear surfaces. A plurality of first terminals is assembled to the first passageways from the rear face. Each terminal has an insulation displacement section extending beyond the rear face. At least a slot is defined in the rear face separating at least one terminal from the rest of the first terminals thereby preventing sparks generated from therebetween. A cover is assembled to the rear face enclosing the insulation displacement sections of the terminals. The cover includes a barrier received in the slot of the housing thereby eliminating sparks resulted when the one terminal carries high voltage.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENTS

Figure 1:
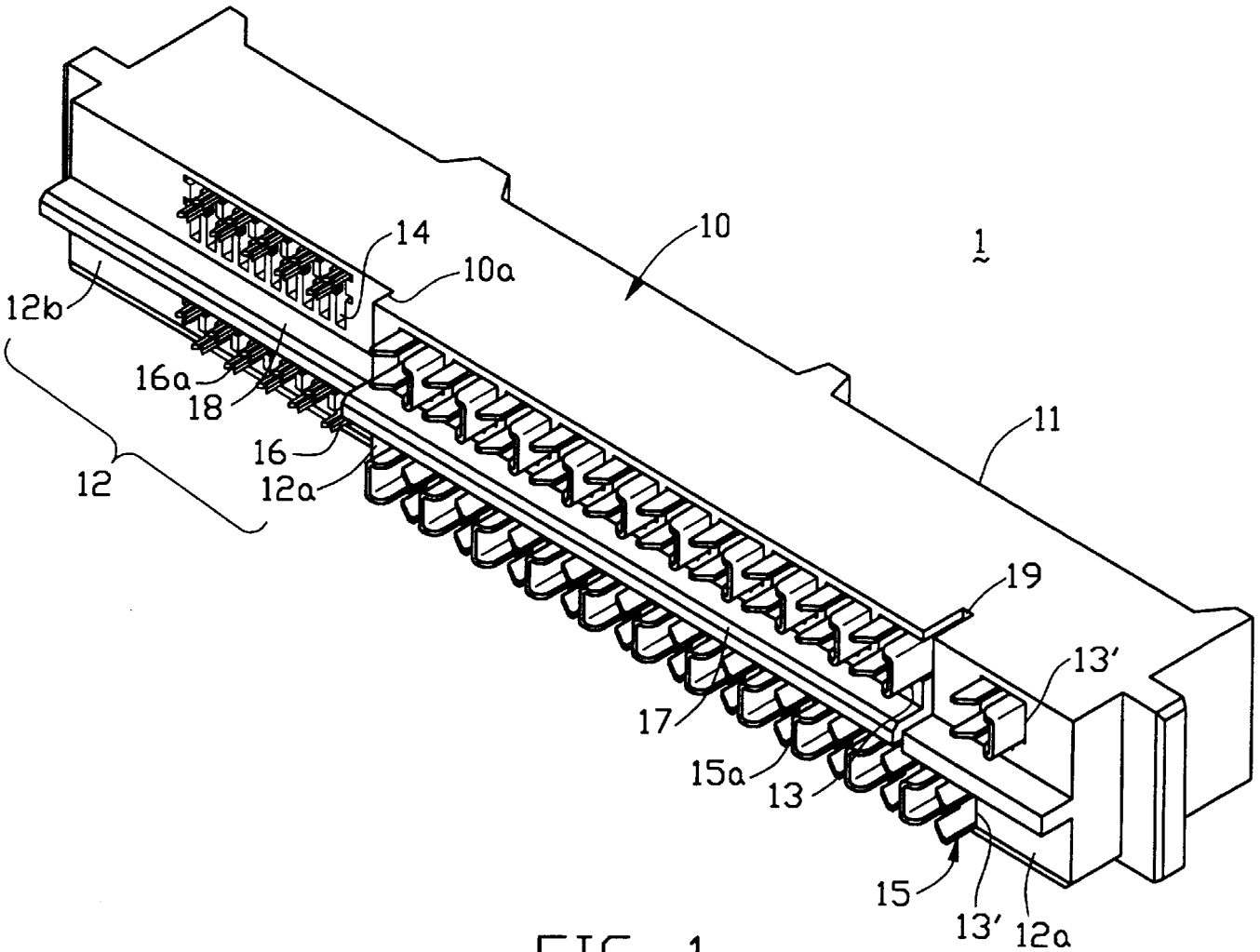
FIG. 1 is a perspective view of a connector in accordance with a first embodiment of the present invention.

Referring to Figures, an electrical connector assembly 1 in accordance with the present invention comprises a housing 10 having mating and rear surfaces 11, 12. The rear face 12 of the housing 10 defines first and second tiers 12*a* and 12*b*. First and second passageways 13, 14 are defined in the first and second tiers 12*a*, 12*b*, respectively. The first and second tiers 12*a*, 12*b* is separated by a shoulder 10*a*. Each of the first and second passageways 13, 14 is received with first and second terminals 15, 16 which are different in dimension. The first and second terminals 15, 16 each includes an insulation displacement section 15*a*, 16*a* which extend beyond the first and second tiers 12*a*, 12*b*. Of course, the first and second terminals 15, 16 may also have other type of tails, such as right angle tails for surface mount. First and second separating walls 17, 18 extend longitudinally along the rear face 12 such that the passageways 13, 14 are divided into upper and lower rows.

A slot 19 is defined in the first tier 12*a* of the rear face 12 of the housing 10 thereby separating two passageways 13' from the rest of the passageways 13. The passageway 13' in the upper row is distant from the slot 19 and is offset from the passageway 13' of the lower row. The arrangement is to prevent electrical sparks therebetween and between the rest of the terminals 13.

Figure 2:
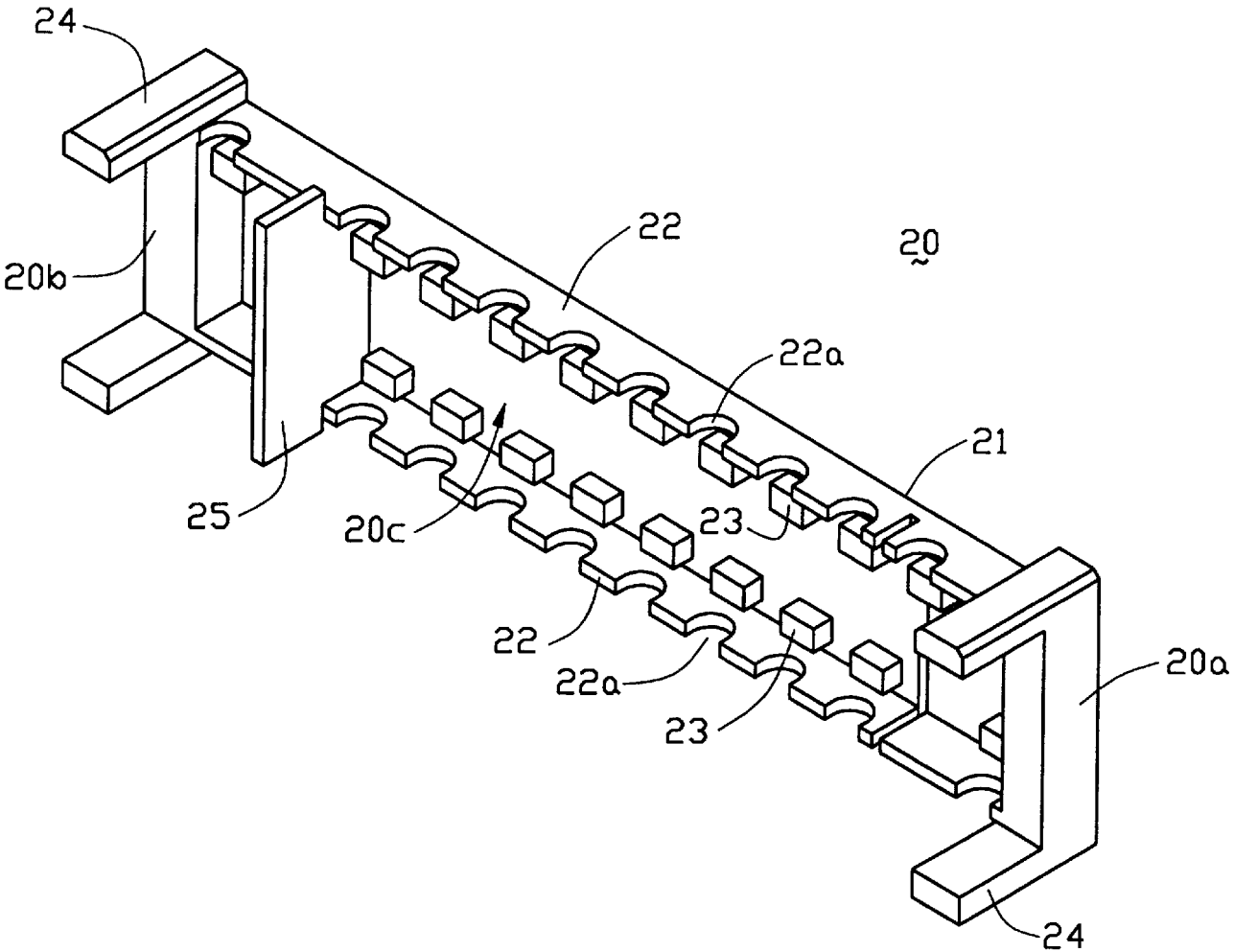
FIG. 2 is a first cover attached to the connector of FIG. 1.

First and second covers 20, 30 are attached to the first and second tiers 12*a*, 12*b* respectively. As shown in FIG. 2, the first cover 20 includes an elongate body portion 21 extending between opposite ends 20*a*, 20*b* thereof. Side walls 22 extend along the elongate body portion 21 and define a receiving space 20*c* therebetween. The side walls 22 each defines a plurality of cutouts 22*a* for extension of conductive wires 40, 41. A plurality of biasing blocks 23 extend upward from the body portion 21 and each aligns with and is dimensioned to be adapted to be inserted into the U-shaped cross-sectional tip of a corresponding insulation displacement section 15*a* of the first terminal 15. By this arrangement, the conductive wires 40, 41 terminated to the insulation displacement sections 15*a*, 16*a* can be urged by the biasing blocks 23 to be fixedly positioned as the biasing blocks 23 are inserted into tips of the insulation displacement sections 15*a*, 16*a*. Retention arms 24 are formed on opposite ends 20*a*, 20*b*. The first cover 20 further includes a barrier 25 extending from the body portion 21. When the first cover 20 is assembled to the first tier 12*a* of the rear face 12 of the housing 10, the retention arms 24 may securely attach the outer face of the housing 10, while the barrier 25 extends into the slot 19 thereby further separating the terminal 13' and the rest of the terminal 13.

Figure 3:
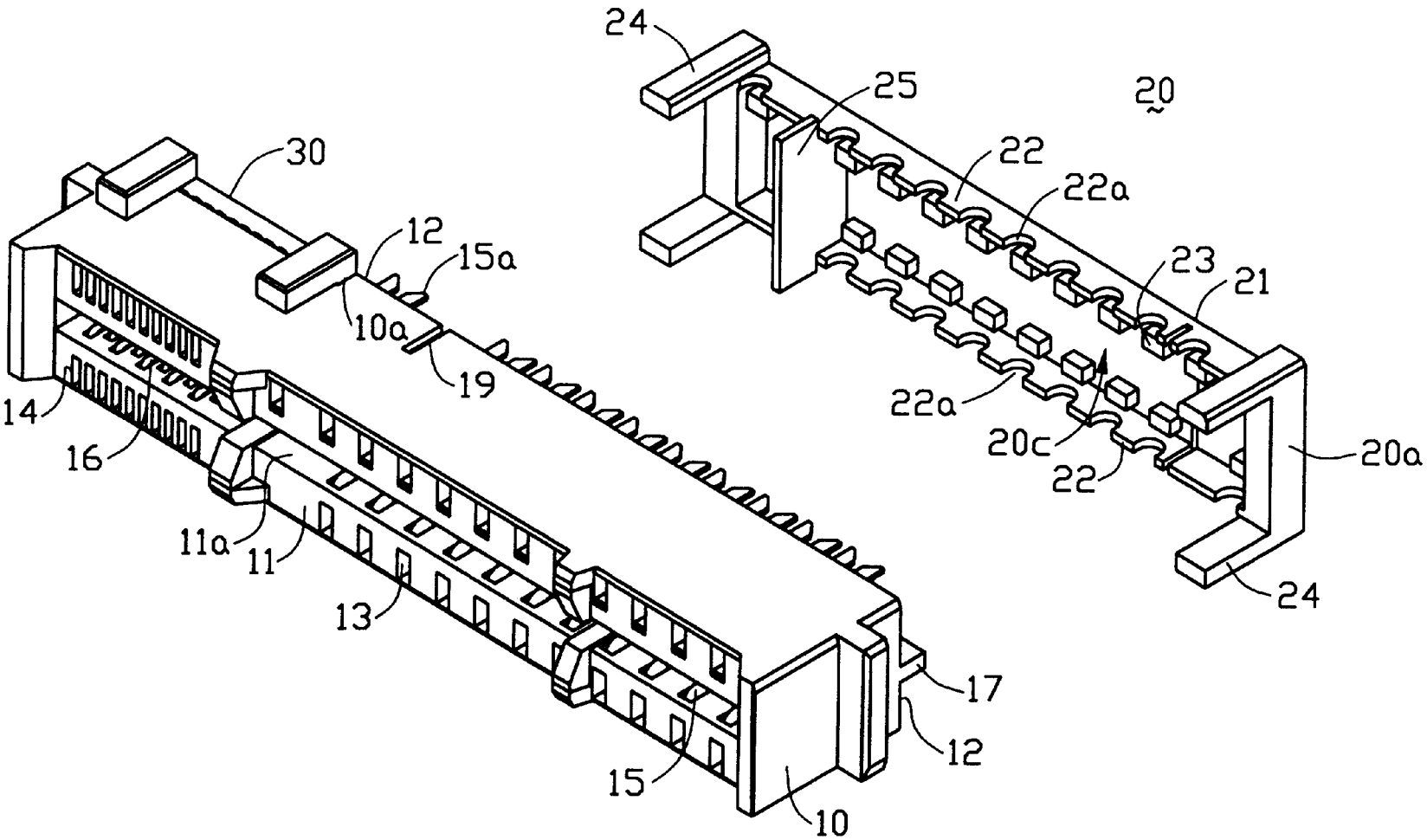
FIG. 3 is an exploded view of the connector with first detached therefrom and a second cover attached thereto.

As shown in FIG. 3, the mating face 11 of the housing 10 defines an elongate slot 11*a* which is in communication with the first and second passageways 13, 14. Contact portions 13*b*, 14*b* of the terminals 13, 14 extend into the elongate slot 11*a* for electrically connecting with an mating connector (not shown). The second cover 30 which is identical to the first cover 20 is attached to the second tier 12*b* of the rear face 12 of the housing 12. The only difference of the first and second cover 20, 30 is the barrier 29 formed on the first cover 30.

Figure 4:
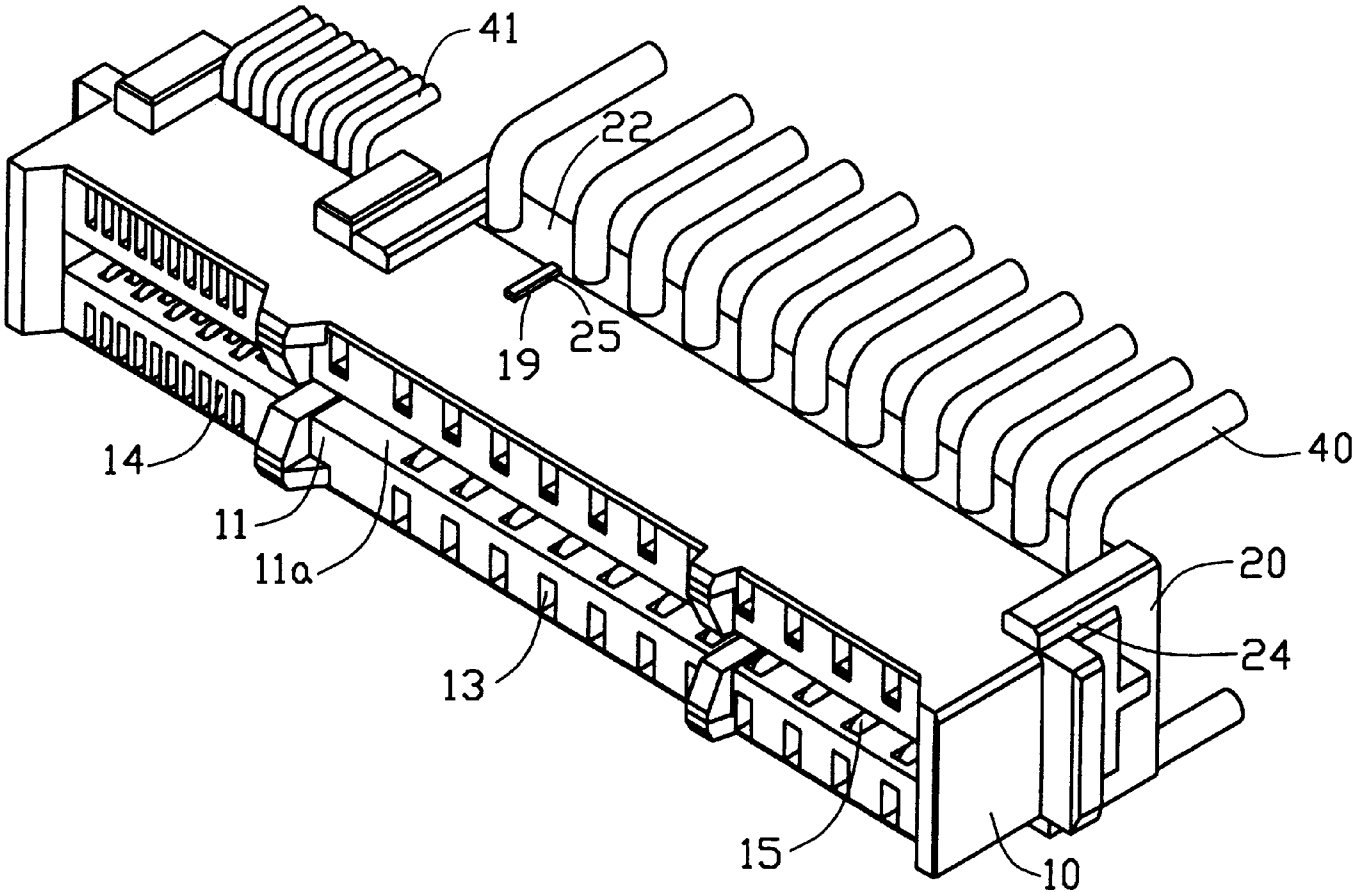
FIG. 4 is a perspective view of FIG. 3 with conductive wires attached thereto.

FIG. 4 is a perspective view of the connector 1 with the conductive wires 40, 41 terminated thereto. The first and second covers 20, 30 are also assembled to the housing 10.

Figure 5:
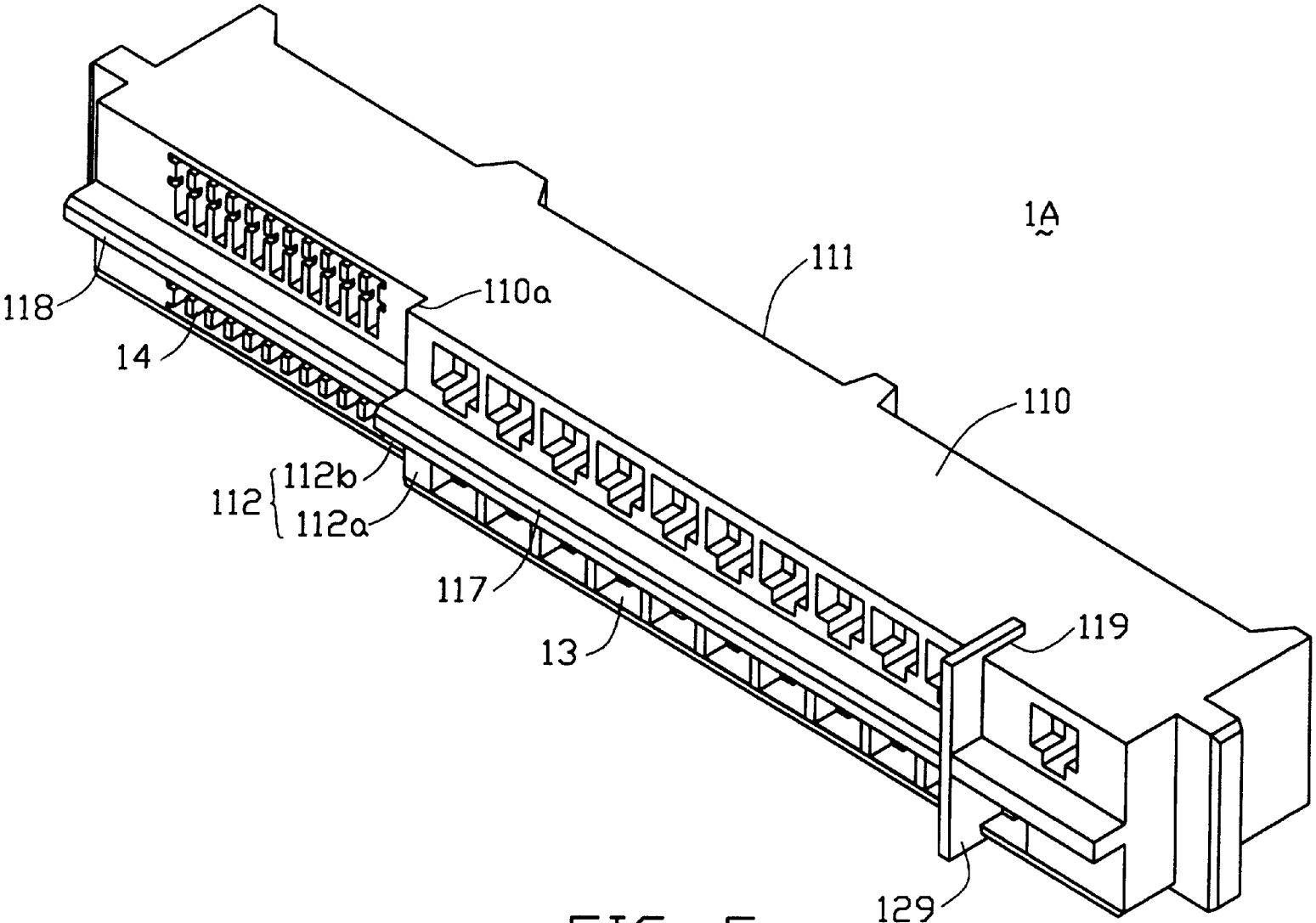
FIG. 5 is a perspective of a connector in accordance with a second embodiment of the present invention.
Figure 6:
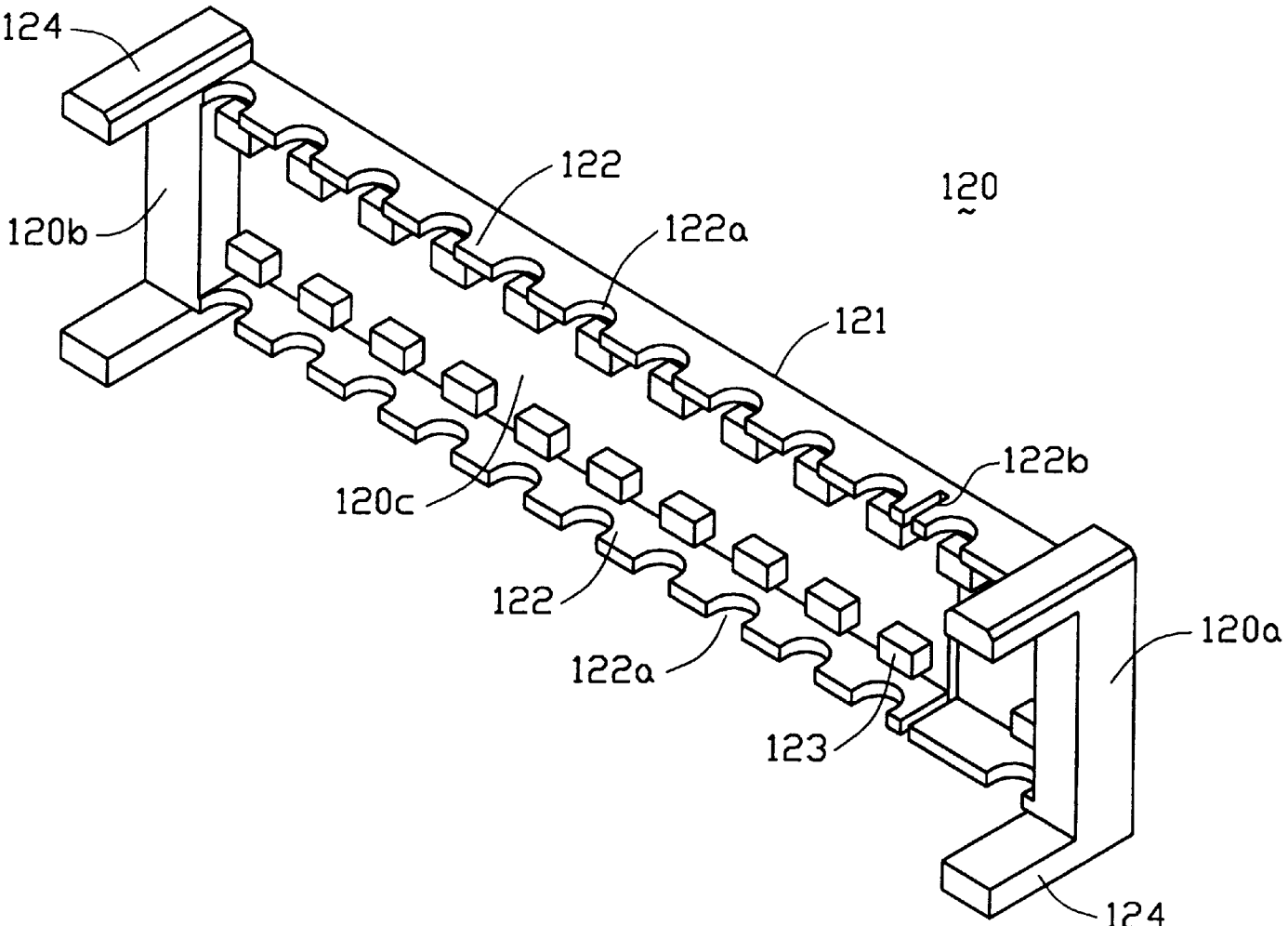
FIG. 6 is a perspective view of a third cover attached to the connector of FIG. 5.

Referring to FIGS. 5 and 6, a connector 1A in accordance with a second embodiment of the present invention is shown.

The electrical connector assembly 1A in accordance with the present invention comprises a housing 110 having mating and rear surfaces 111, 112. The rear face 112 of the housing 110 defines first and second tiers 112*a* and 112*b*. First and second passageways 113, 114 are defined in the first and second tiers 112*a*, 112*b*, respectively. The first and second tiers 112*a*, 112*b* is separated by a shoulder 110*a*. Each of the first and second passageways 113, 114 is received with first and second terminals (not shown) which are different in dimension. First and second separating walls 117, 118 extend longitudinally along the rear face 112 such that the passageways 113, 114 are divided into upper and lower rows. A slot 119 is defined in the first tier 112*a* of the rear face 112 of the housing 110. An individual barrier 129 is inserted therein thereby eliminating electrical sparks between the terminals.

A third cover 120 can be assembled to the first tier 112*a* of the rear face 112 of the housing 120 to enclose the terminals thereof. The third cover 120 includes an elongate body portion 121 extending between opposite ends 120*a*, 120*b* thereof. Side walls 122 extend along the elongate body portion 121 and define a receiving space 120*c* therebetween. The side walls 122 each defines a plurality of cutouts 122*a* for extension of conductive wires 40, 41 (as shown in FIG. 4). A plurality of biasing blocks 123 extend upward from the body portion 121 and each aligns with a corresponding insulation displacement section of the first terminal. By this arrangement, the conductive wires terminated to the insulation displacement sections can be fixedly positioned as the biasing block 123 is inserted into the tips of the insulation displacement section. Retention arms 124 are formed on opposite ends 120*a*, 120*b*. When the third cover 120 is assembled to the first tier 112*a* of the rear face 112 of the housing 110, the retention arms 124 may securely attach the outer face of the housing 110. The cover 120 further defines a slot 122*b* in the side walls 122 for accommodating the individual barrier 129.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector assembly, comprising:

a housing having mating and rear surfaces, and defining first passageways between said mating and rear surfaces;

a plurality of first terminals assembled to said first passageways from said rear face, each terminal having an insulation displacement section extending beyond said rear face; and at least a slot defined in said rear face separating at least one terminal from the rest of said first terminals thereby preventing sparks generated from therebetween; and a first cover attached to said housing for enclosing said insulation displacement sections, said first cover comprising an elongate body portion extending between opposite ends thereof, side walls extending along said elongate body portion and defining a receiving space therebetween, a plurality of biasing blocks extending upward said body portion, retention means arranged in opposite ends thereof;

wherein said first passageways are arranged in upper and lower rows, and a first separating wall extending rearward from said rear face and arranged between said upper and lower passageways;

wherein said first separating wall is higher than said insulation displacement section of said terminals;

wherein said cover includes a barrier fixedly received in said slot of said housing thereby separating said one terminal from the rest of said terminals;

wherein said housing defines a second group of passageways each assembling a second terminal different from said first terminal;

wherein said second terminal includes an insulation displacement section extending beyond rear face, said rear face defines first and second tiers in which said first and second insulation displacement of said first and second terminals locate;

wherein said second passageways are arranged in upper and lower rows divided by a second separating wall, said second separating wall is higher than said insulation displacement sections of said second terminals;

wherein said insulation displacement sections located in said second tier is enclosed by a second cover attached thereto;

wherein said retention means includes a pair of beams capable of engaging with said housing;

wherein said cover includes a barrier includes a barrier extending between said side walls;

wherein said barrier is assembled to said slot located in said rear face of said housing.

* * * * *